US007869993B2

(12) United States Patent
Ojala

(10) Patent No.: US 7,869,993 B2
(45) Date of Patent: Jan. 11, 2011

(54) METHOD AND A DEVICE FOR SOURCE CODING

(76) Inventor: Pasi S. Ojala, Laurintie 4 D, FI-33880, Lempäälä (FI)

( * ) Notice: Subject to any disclaimer, the term of this patent is extended or adjusted under 35 U.S.C. 154(b) by 1039 days.

(21) Appl. No.: 10/574,990

(22) PCT Filed: Oct. 4, 2004

(86) PCT No.: PCT/FI2004/000579

§ 371 (c)(1),
(2), (4) Date: Jan. 8, 2007

(87) PCT Pub. No.: WO2005/034090

PCT Pub. Date: Apr. 14, 2005

(65) Prior Publication Data

US 2007/0156395 A1 Jul. 5, 2007

(30) Foreign Application Priority Data

Oct. 7, 2003 (FI) ..... 20031462

(51) Int. Cl.
*G10L 21/00* (2006.01)

(52) U.S. Cl. ..... 704/220; 704/223; 381/220

(58) Field of Classification Search ..... 704/220, 704/223; 381/23
See application file for complete search history.

(56) References Cited

U.S. PATENT DOCUMENTS 4,720,862 A * 1/1988 Nakata et al. ..... 704/214
4,881,267 A * 11/1989 Taguchi ..... 704/221
4,945,565 A * 7/1990 Ozawa et al. ..... 704/223
5,119,424 A * 6/1992 Asakawa et al. ..... 704/208
6,175,817 B1 1/2001 Mueller et al. ..... 704/222
2003/0097258 A1 5/2003 Thyssen ..... 704/222

FOREIGN PATENT DOCUMENTS

EP 0 307 122 3/1989
EP 0 602 826 B1 8/1999
EP 1 098 298 A2 5/2001

OTHER PUBLICATIONS

The International Search Report and Written Opinion for PCT/FI2004/000579 mailed Feb. 10, 2005.
The Communication for EP application No. 04767093 dated Apr. 4, 2008.

* cited by examiner

*Primary Examiner*—Daniel D Abebe

(57) ABSTRACT

A method and a device for source coding with a time advanced excitation signal. During an encoding process, a source data signal is first divided into consecutive blocks, then a first set of parameters related to a filter describing properties of a first block covering a first time period is extracted, followed by the extraction of a second set of parameters related to an excitation signal for said filter, where said second set of parameters is determined from and describing properties of both the first block and a second block following the first block within a second time period starting later than said first time period and extending outside said first time period.

26 Claims, 8 Drawing Sheets

METHOD AND A DEVICE FOR SOURCE CODING

FIELD OF THE INVENTION

The present invention relates generally to source coding of data. In particular the invention concerns predictive speech coding methods that represent speech signal via a speech synthesis filter and an excitation signal thereof.

BACKGROUND OF THE INVENTION

Modern wireless communication systems such as GSM (Global System for mobile communications) and UMTS (Universal Mobile Telecommunications System) transfer various types of data over the air interface between the network elements such as a base station and a mobile terminal. As the general demand for transfer capacity continuously rises due to e.g. new multimedia services coming available, new more efficient techniques have to be developed respectively for data compression as radio frequencies can nowadays be considered as scarce resources. Data compression is traditionally also used for reducing storage space requirements in computer data systems, for example. Likewise, different methods for picture, video, music and speech coding have been developed during the last few decades.

Data is usually compressed (~compacted) by utilizing a so-called encoder to be subsequently regenerated with a decoder for later exploitation whenever needed. Data coding techniques may be classified according to a number of different approaches. One is based on the coding result the (en) coder produces; a lossless encoder compacts the source data but any information is actually not lost during the encoding process, i.e. after decoding the data matches perfectly with the un-encoded data, meanwhile a lossy coder produces a compacted presentation of the source data the decoding result of which does not completely correspond to the original presentation anymore. However, a data loss is not a problem in situations wherein the user of the data cannot either distinguish the differences between the original and once compacted data, or the differences do not, at least, cause severe difficulties or objection in exploiting slightly degraded data. As human senses including hearing and vision are somewhat limited it's, for example, possible to extract unnecessary details from pictures, video or audio signals-without considerably disturbing the final sensation effect. Often source coders produce fixed rate output meaning the compaction ratio does not depend on the input data. Alternatively, a variable-rate coder takes statistics of the input signal into account while analysing it thus outputting compacted data with variable rate. Variable-rate coding surely has certain benefits over fixed-rate models. Considering e.g. the field of speech coding a variable-rate codec (coder-decoder) can maximise the capacity and minimize the average bit-rate for given speech quality. This originates from the non-stationarity (or quasi-stationarity) of a typical human speech signal; a single speech segment, as the coders process a certain period of speech at a time, may comprise either very homogenous signal (e.g. periodically repetitive voiced sound) or strongly fluctuating signal (transitions etc) thus directly affecting the minimum amount of bits required for sufficient representation of the segment under analysis. In addition, considering especially mobile networks achieved savings in source coding may be used for enhancing e.g. channel coding thus resulting a better tolerance against interference on the radio path. Fixed-rate coders always need to operate at a compromise rate that is low enough to save transmission capacity but high enough to code difficult segment with adequate quality, the compromise rate obviously being unnecessary high for "easier" speech segments.

Still, as the nature and targeted use of the source data defines on case-by-case basis the optimum means for compacting it, an idea of a generic optimum coder directly applicable for any possible scenario is utopistic; development of source coding has been diverged into many directions utilizing the data statistics and imperfections of human senses into maximum account in a specialized manner.

In case of mobile networks a speech coder is definitely one of the most crucial elements in providing the caller/callee a satisfactory call experience in addition to various voice storage and voice message services. Modern speech coders have a common starting point: compact representation of digitised speech while preserving speech quality, truly a subjective measure concerning e.g. speech intelligibility and naturalness although sometimes also "objectively" measured by utilizing weighted distortion measures, but the techniques used in modeling greatly vary. One speech-coding model heavily utilized today is called CELP (Code Excited Linear Prediction). CELP coders like GSM EFR (Enhanced Full Rate), UMTS adaptive multi-rate coder AMR and TETRA ACELP (Algrebraic Code Excited Linear Prediction) belong to the group of AbS (Analysis by Synthesis) coders and produce the speech parameters by modeling the speech signal via minimizing an error between the original and speech in a loop. CELP coders carry features from both waveform (common PCM etc) and vocoder techniques.

Vocoders are parametric coders that exploit, for example, a source-filter approach in speech parameterisation. The source models the signal originated by air-flow emitting from the lungs to glottis either through vibrating (resulting voiced sounds) or stiff (resulting unvoiced sounds with turbulence originated from different shapes within the vocal tract) vocal cords up to the oral cavities (mouth, throat) to be finally radiated out through the lips.

FIG. 1 discloses a generic sketch of a simplified human speech production model, called an LP (Linear Predictive) model that is utilized in many contemporary speech coding methods like CELP. The process is called linear prediction since current output S(n) is determined by a weighted sum of previous output values and an input value generated by pulse source 102 or noise source 104 depending on the nature of speech, roughly being divided to either voiced in the first and unvoiced in the latter case. Pulse source 102 emitting the impulse train imitates the vibration at the glottis with a corresponding fundamental frequency called a pitch frequency with a certain pitch period. Source type may be altered during the synthesis process via switch 106. Before filtering the excitation source signal with all-pole IIR (Infinite Impulse Response) filter 110 modeling the vocal tract it is multiplied by a proper gain factor in multiplier 108. Therefore, speech synthesis can be performed by first defining the class of current speech segment under consideration as either voiced or unvoiced, and then by driving the excitation signal of the selected type through a multiplier and a synthesis filter. More about LP and speech modeling or coding in general can be found in reference [1].

A typical CELP coder, presented in FIG. 2, and a corresponding decoder, presented in FIG. 3, comprises several filters for modeling speech generation, namely at least a short-term filter such as an LP(C) synthesis filter used for modeling the spectral envelope (formants; resonances introduced by vocal tract) and a long-term filter the purpose of which is to model the oscillation of the vocal cords inducing periodicity in the voiced excitation signal comprising impulses separated by the current pitch period called a lag. The modeling is substantially targeted to a single speech segment, called a frame hereinafter, at a time. As can be noticed from FIG. 3, the decoder structure reminds of the common LP synthesis model with an additional LTP (Long-Term Prediction) filter. The excitation signal is created on the basis of an excitation vector for the respective block. For example, in ACELP coders the excitation consists of a fixed number of non-zero pulses the position and amplitude of which is selected by utilizing a search in which a perceptually weighted error term between the original and synthesized speech frame is minimized.

Considering CELP encoding and decoding in more detail a preview of codec internals is presented herein. The encoder includes short-term analysis function 204 to form a set of direct form filter coefficients called LP parameters a(i), where i=1, 2, . . . , m (m thus defining the order of the analysis), for example. Parameters a(i) are calculated once for a speech frame of N samples, N corresponding e.g. a time period of 20 milliseconds. As speech has a quasi-stationary nature meaning it may be considered as stationary if the inspection period is short enough (<=20 ms), optimum filter coefficients can be calculated for a single frame by utilizing standard mathematic means such as Wiener filter theory, which requires signal stationarity, on frame-by-frame basis. Resulting equation with computationally exhaustive matrix inversion may then be effectively calculated by exploiting e.g. so-called autocorrelation method and Levinson-Durbin recursion. See reference [2] for further information. LP parameters a(i) are exploited in searching the lag value matching best with the speech frame under analysis, in calculating a so-called LP residual by filtering the speech with LPC analysis (or "inverse") filter, being the inverse A(z) of LPC synthesis filter 1/A(z), and naturally as coefficients of LPC synthesis filter 210 while creating a synthesized speech signal ss(n). The lag value is calculated in LTP analysis block 202 and used by LTP synthesis filter 208. The long-term predictor and corresponding synthesis filter 208 being the inversion thereof is typically like an LP predictor with a single tap only. The tap may optionally have a gain factor g2 of its own (thus defining the total gain of the one tap LTP filter). LP parameters are also utilized in the excitation codebook search as described below.

In a basic CELP coder, after definition of proper lag value T and LP parameters a(i), iteration for a perfect excitation codebook vector according to the selected error criteria is started. In some advanced coding models it's possible to fine-tune the lag value or even LP parameters while searching a perfect excitation vector. During an iteration round, excitation vector c(n) is selected from codebook 206, filtered through LTP and LPC synthesis filters 208, 210 and the resulting synthesised speech ss(n) is finally compared 218 with the original speech signal s(n) in order to determine the difference, error e(n). Weighting filter 212 that is based on the characteristics of human hearing is used to weight error signal e(n) in order to attenuate frequencies at which the error is less important according to the auditory perception, and to correspondingly amplify frequencies that matter more. For example, errors in the areas of "formant valleys" may be emphasized as the errors in the synthesized speech are not so audible in the formant frequencies due to the auditory masking effect. Codebook search controller 214 is used to define index u of the code vector in codebook 206 according to the weighted error term acquired from weighting filter 212. Consequently, index u indicating a certain excitation vector leading to a minimum possible weighted error is eventually selected. Controller 214 provides also scaling factor g that is multiplied 216 with the code vector under analysis before LTP and LPC synthesis filtering. After a frame has been analysed, parameters describing the frame (a(i), LTP parameters like T and optionally also gain g2, codebook vector index u or other identifier thereof, codebook scaling factor g) are sent over transmission channel (air interface, fixed transfer medium etc) to the speech decoder at the receiving end.

Referring to FIG. 3, excitation codebook 306 corresponds to the one in the encoder used for generating excitation signal c(n) on the basis of received codebook index u. Excitation signal c(n) is then multiplied 312 with scaling factor g and directed to LTP synthesis filter supplied with necessary parameters T and g2. Finally the effect of the vocal tract is added to the synthesized speech signal by LPC synthesis filtering 310 providing decoded speech signal ss(n) as an output.

Considering next fixed codebook vector selection in an ACELP type speech encoder, the pulse positions are determined by minimizing the error between the actual weighted input speech and a synthesized version thereof:

$$e^2=(s_p-g_2HV-gHc)^2 \tag{1}$$

where $s_p$ is perceptually weighted input speech, H is an LP model impulse response matrix utilizing calculated LP parameters, c is the selected codebook vector and v is a so-called "adaptive codebook" vector explained later in the text. The minimization of the above error is in practise performed by maximizing the term:

$$\frac{(\tilde{s}^T Hc_k)^2}{c_k^t H^t Hc_k} \tag{2}$$

where $\tilde{s}=s_p-g_2Hv$ is hereinafter called a "target signal" being equivalent to the perceptually weighted input speech signal from which the contribution of the adaptive codebook has been removed. k is the index of fixed codebook vector c under analysis.

The concept of the adaptive codebook is illustrated in FIG. 4 disclosing the CELP synthesis model in an alternative manner being quite similar to the common human speech production model of FIG. 1. However, the main difference lies in the excitation signal generation part: as seen from FIG. 4 in CELP coders the selection of voiced/unvoiced excitation is not usually made at all and the excitation includes adaptive codebook part 402 and fixed codebook part 404 corresponding to excitation signals v(n) and c(n) respectively, which are first individually weighted g2, g and then summed 408 together to form final excitation u(n) for LPC synthesis filter 410. Thus the periodicity of the LP residual presented in FIGS. 2 and 3 with a separate LTP filter connected in series with the LPC synthesis filter can be alternatively depicted as a feedback loop and adaptive codebook 402 comprising a delay element controlled by lag value T.

To concretise the goal of the algebraic fixed codebook search that is performed after LPC and LTP analysis stages, an imaginary target signal of a single frame that should be modeled with an algebraic codebook to a maximum extent is presented in FIG. 5. Now if two pulses are to be allocated per frame (bold arrows), an optimum position for them is nearby peaks 502, 504 in order to minimize the energy left in the remaining error signal. In this particular example, exactly two pulses with adjustable sign can be included in the frame. In a typical encoder, the number of codebook pulses per frame and amplitudes thereof is predefined although the overall amplitude of codebook vector c(n) can be altered via gain factor g.

In addition to mere frames the original signal may be divided into a number of sub-frames (e.g. 1-4) as well, which are then separately parameterised in relation to all or some of the required parameters. For example, LPC analysis that results LPC coefficients may be executed only once per frame thus a single set of LP parameters covers the whole frame whereas codebook vectors (fixed algrebraic and/or adaptive) can be analysed for each sub-frame.

Gain factor g can be calculated by $$g = \frac{\tilde{s}^T H c_k}{c_k^T H^T H c_k}. \tag{3}$$

Although contemporary methods for modeling and regenerating an applicable excitation signal for EP synthesis filter seem to provide somewhat adequate results in many cases, a number of problems still exist therein. It's obvious that depending on the original input signal the prediction error may or may not have serious peaks left in the time domain presentation. The scenario can vary, and thus the fixed number of corrective pulses per frame may sometimes be enough to rise the modeling accuracy into a moderate level but sometimes not. Occasionally, as with some of the existing speech coders, the modeling result may actually get worse by adding unnecessary pulses into the excitation signal when the codec specifications do not allow to alter the number of pulses in a single frame. On the other hand, if the number of pulses in a frame and thus the total output bitrate is varied, the modeling process is surely more flexible but also more complex what comes to reception of variable length frames etc. Variable output bit-rate may also complicate network planning as transmission resources required by a single connection for transferring speech parameters are not fixed anymore.

FIG. 8A discloses a target signal in a scenario wherein a frame has been divided into four sub-frames. LPC analysis is performed once per frame, and LTP and fixed codebook analysis on a sub-frame basis. The target signal comprises severe fluctuations 802, 804, 806, 808 in sub-frame 3. However, as algebraic code vectors contain only two pulses sharp, they may be placed to cover peaks 802 and 804, but peaks 806 and 808 are left intact thus reducing the modeling result.

Another defect in prior art coders relates to so called closed-loop search of the adaptive codebook vector relating to the LTP analysis.

Usually an open-loop analysis is executed first in order to find a rough estimate of the lag T and gain g2 concerning e.g. a whole frame at a time. During open-loop search a weighted speech signal is just correlated with delayed versions of itself one at a time in order to locate correlation maximas. Considering found occurrences of these autocorrelation maximas, the corresponding delay values, in principle especially the one producing the highest maximum, then moderately predict the lag term T as the correlation maximum often results from the speech signal periodicity.

Thereafter, in a more accurate closed-loop adaptive codebook search LTP filter lag T and gain g2 values are determined by minimizing the weighted error between the original and synthesized speech as in the algrebraic fixed codebook search. This is achieved e.g. in the AMR codes on sub-frame basis by maximizing the term:

$$R(k) = \frac{\sum_{n=0}^{L} s_p(n) y_k(n)}{\sqrt{\sum_{n=0}^{L} y_k(n) y_k(n)}} \tag{4}$$

where L is sub-frame length (e.g. 40 samples) −1, y(n)=v(n) *h(n) and yk is thus the past LP synthesis filtered excitation (adaptive codebook vector) at delay k. More details about open/closed loop searches especially in the case of AMR codec can be found in reference [3]. However, as it's clear that the actual excitation for the span of the current frame is still unknown upon maximising the above term, the current LP residual is used as substitute in scenarios with short delay values. See FIG. 9A for clarification. If delay k is short enough, i.e. signal yk requires samples from the current sub-frame, any excitation for the current sub-frame is not yet available as the algebraic search is still to be conducted. Therefore, a straightforward solution is to use already available LP residual (may be initially calculated even to the whole frame) as a substitute for the missing part of the excitation vector corresponding to a time period between legends 902 and 904. On the other hand, a buffer for previous excitation can usually be made large enough, three dots emphasize this in the figure, in order to avoid situations where delay k is correspondingly too long, and the required excitation is not available in the buffer anymore.

SUMMARY OF THE INVENTION

The object of the present invention is to improve the excitation signal modeling and alleviate the existing defects in contemporary source coding, e.g. speech coding, methods. The object is achieved by introducing the concept of time advanced excitation generation. The excitation signal generated by, for example, fixed excitation codebook is determined in advance to partly cover the next frame or sub-frame as well in addition to the current frame. Hence the codebook is "time advanced" e.g. half of the (sub-)frame length forward. This is achieved without increasing the overall coding delay whenever a frame look-ahead is in any case applied in the coding procedure. Look-ahead is an additional buffer that already exists in many state of the art speech coders and includes samples from the following frame. The reason why look-ahead buffer is originally included in the encoders is based on the LP modeling: during the LPC analysis of the current frame it has been found advantageous to take the forthcoming frame into account as well in order to guarantee smooth enough transition between the adjacent frames.

The aforesaid procedure offers a clear advantage over the prior art especially when the LP residual has occasional peaks embedded. This results from the fact that actually the number of pulses in a (sub-)frame may be doubled by advancing pulses from a certain frame to the adjacent next frame. Thus the invention entails benefits of the variable-rate source coding on frame-by-frame basis but the true bit rate of the encoded signal at the output is fixed, and the overall system complexity remains at a relatively low level compared to solutions with traditional variable-rate coders. The core invention is still applicable both to fixed-rate and variable-rate coders.

Respectively, as the true time advanced excitation can be used instead of LP residual during the closed loop search of the adaptive codebook parameters, the error signal modeling result is improved.

According to the invention, a source coding method enabling at least partial subsequent reconstruction of source data with a synthesis filter and an excitation signal thereof has the steps of dividing the source data signal into consecutive blocks, extracting a first set of parameters related to said filter describing properties of a first block covering a first time period, and extracting a second set of parameters related to said excitation signal for said filter, where said second set of parameters is determined from and describing properties of both the first block and a second block following the first block within a second time period starting later than said first time period and extending outside said first time period.

In another aspect of the invention, a method for decoding encoded data signal divided into consecutive blocks has the steps of obtaining a first set of parameters for constructing a synthesis filter, said first set of parameters describing properties of a first block covering a first time period, obtaining a second set of parameters for constructing an excitation signal for said synthesis filter, said second set of parameters describing properties of both the first block and a second block following the first block within a second time period starting later than said first time period and extending outside said first time period, obtaining at least part of a previous second set of parameters for constructing an excitation signal for said synthesis filter, said previous second set of parameters describing properties of said first block during at least the time period between the beginning of said first time period and the beginning of said second time period, combining the contribution of said previous second set of parameters and said second set of parameters for said excitation signal within the first time period, constructing an excitation signal of said first block for said synthesis filter by utilizing said combination, and filtering said constructed excitation signal through said synthesis filter.

In a further aspect of the invention, an electronic device for encoding source data divided into consecutive blocks to be represented by at least a first and a second set of parameters, comprises processing means and memory means for processing and storing instructions and data, and data transfer means for accessing data, and the device is arranged to determine said second set of parameters describing properties of both a first block covering a first time period, properties of said first block described by said first set of parameters, and a second block following the first block within a second time period starting later than said first time period and extending outside said first time period.

In a further aspect of the invention, an electronic device for decoding source data divided into consecutive blocks, comprises processing means and memory means for processing and storing instructions and data, and data transfer means for accessing data, and the device is arranged to obtain a first set of parameters for constructing a synthesis filter, said first set of parameters describing properties of a first block covering a first time period, a second set of parameters for constructing an excitation signal for said synthesis filter, said second set of parameters describing properties of both the first block and a second block following the first block within a second time period starting later than said first time period and extending outside said first time period, at least part of a previous second set of parameters for constructing an excitation signal for said synthesis filter, said previous second set of parameters describing properties of said first block during at least the time period between the beginning of said first time period and the beginning of said second time period, said device further arranged to combine the contribution of said previous second set of parameters and said second set of parameters for said excitation signal within said first time period, to construct an excitation signal of said first block for said synthesis filter by utilizing said combination, and to filter said constructed excitation signal through said synthesis filter.

In a further aspect of the invention, a computer program for encoding source data divided into consecutive blocks to be represented by at least a first and a second set of parameters, comprises code means to determine said second set of parameters describing properties of both a first block covering a first time period, properties of said first block described by said first set of parameters, and a second block following the first block within a second time period starting later than said first time period and extending outside said first time period.

Still in a further aspect of the invention, a computer program for decoding source data represented by at least a first and a second set of parameters, where said first set of parameters relate to a synthesis filter and said second set of parameters to an excitation signal for said filter, said data divided into consecutive blocks, said first set of parameters describing properties of a first block covering a first time period and said second set of parameters describing properties of both the first block and a second block following the first block within a second time period starting later than said first time period and extending outside said first time period, comprises code means, by utilizing at least part of a previous second set of parameters for constructing an excitation signal for said synthesis filter, said previous second set of parameters describing properties of said first block during at least the time period between the beginning of said first time period and the beginning of said second time period, to combine the contribution of said previous second set of parameters and said second set of parameters for said excitation signal within said first time period, to construct an excitation signal of said first block for said synthesis filter by utilizing said combination, and to filter said constructed excitation signal through said synthesis filter.

The term "set" refers generally to a collection of one or more elements, e.g. parameters.

In an embodiment of the invention, the proposed method for excitation generation is utilized in a CELP type speech coder. A speech frame is divided into sub-frames that are analysed first as a whole, then one at a time. In order to determine an advanced excitation signal, the target signal and the fixed codebook are shifted for example half a sub-frame forward during the analysis stage.

Accompanying dependent claims disclose embodiments of the invention.

BRIEF DESCRIPTION OF THE DRAWINGS

Hereinafter the invention is described in more detail by reference to the attached drawings, wherein FIG. 1 discloses a human speech production model.

DETAILED DESCRIPTION OF THE EMBODIMENT OF THE INVENTION

FIGS. 1-5, 8A, and 9A were already discussed in conjunction with the description of related prior art.

Figure 1:
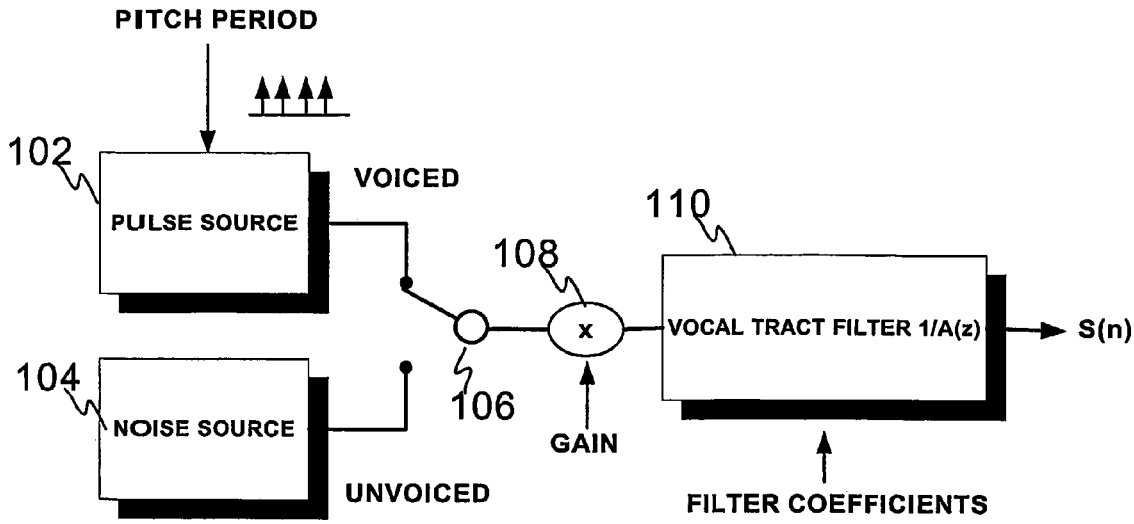
PRIOR ART Figure 1
Figure 2:
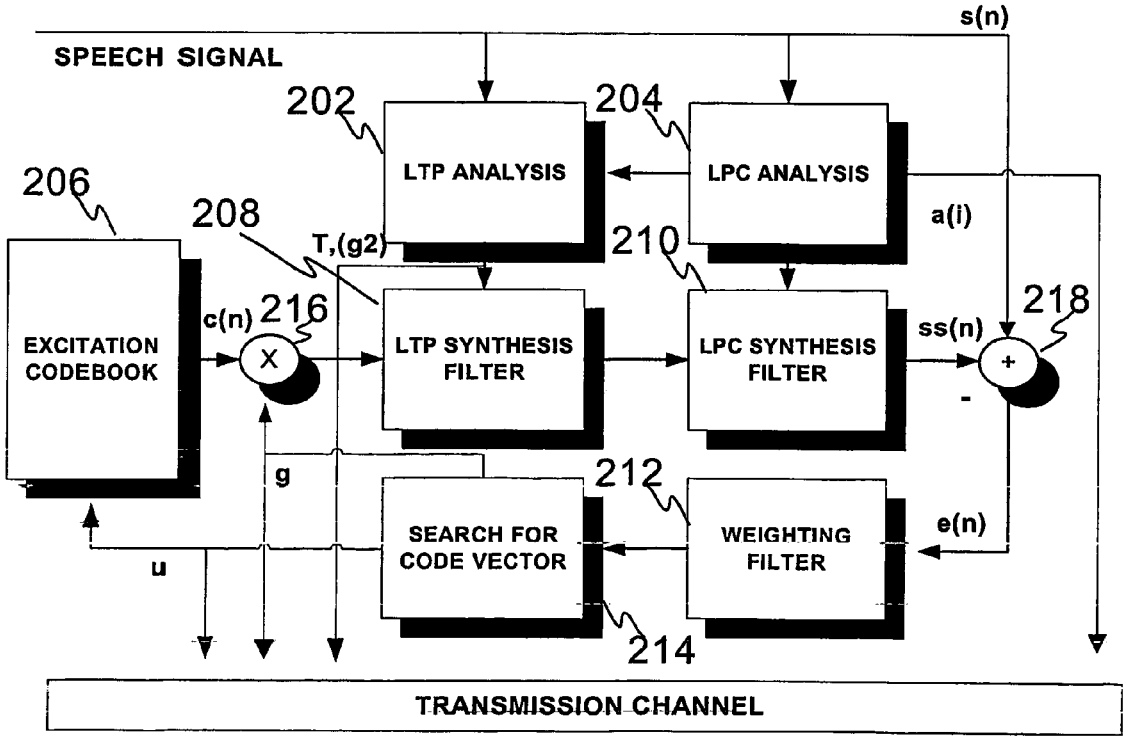
PRIOR ART Figure 2
FIG. 2 illustrates a block diagram of a typical CELP speech encoder.
Figure 3:
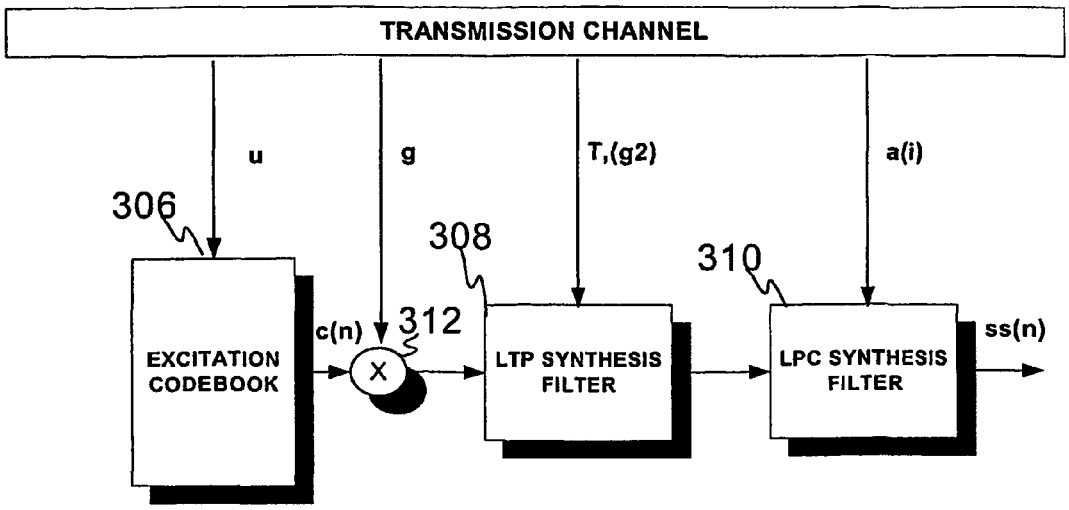
PRIOR ART Figure 3
FIG. 3 illustrates a block diagram of a typical CELP speech decoder.
Figure 4:
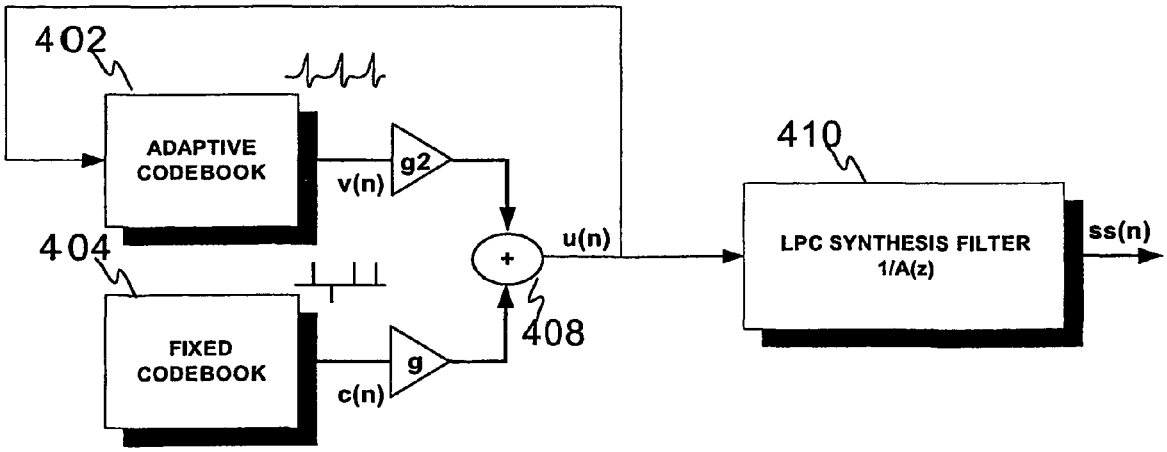
PRIOR ART Figure 4
FIG. 4 depicts a CELP synthesis model for speech generation.
Figure 5:
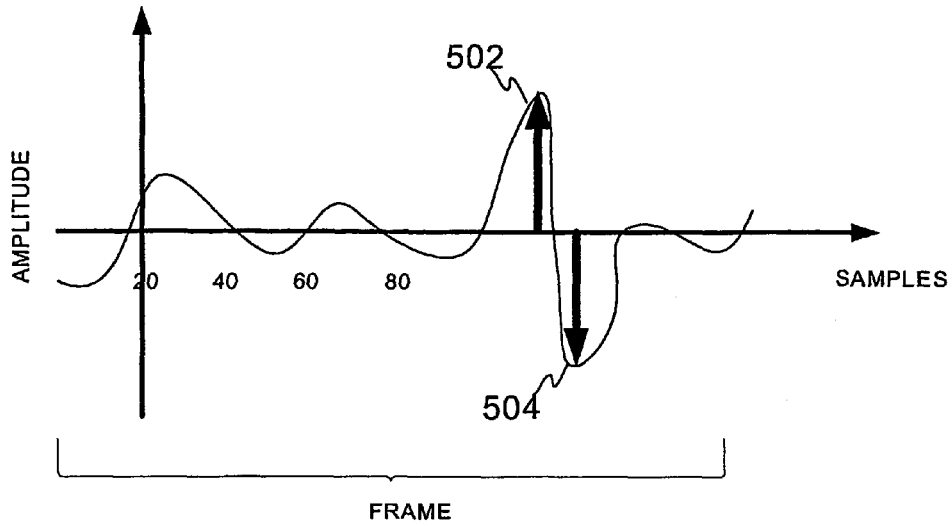
PRIOR ART Figure 5
FIG. 5 discloses a typical scenario in a CELP type speech encoding where the target signal is modeled with a fixed number of pulses included in a single code vector.
Figure 6:
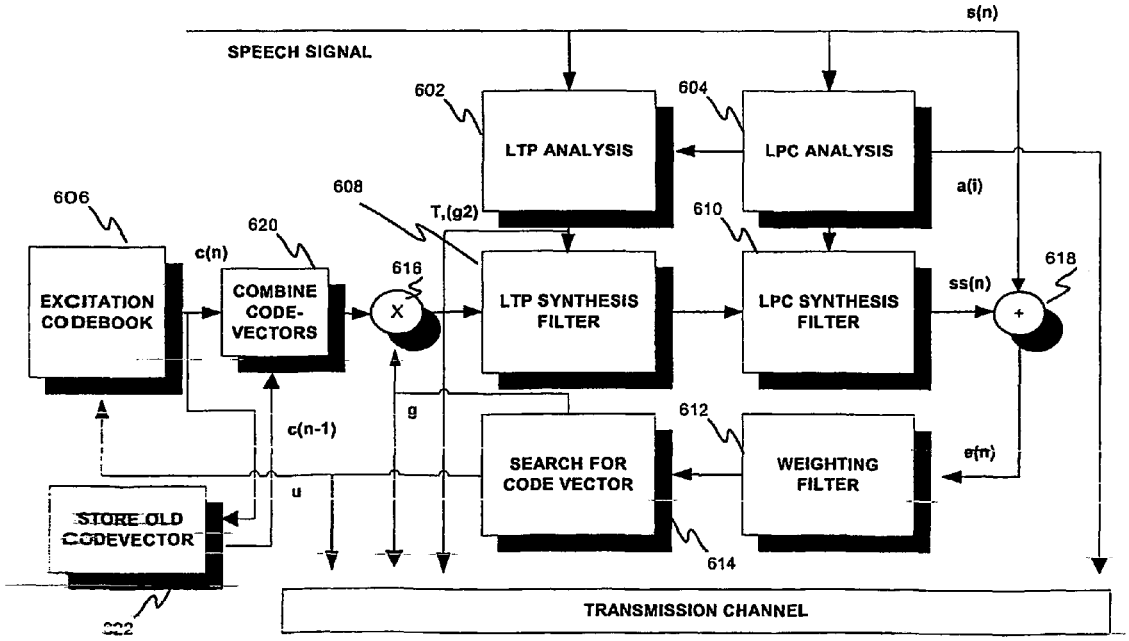
FIG. 6 illustrates a block diagram of a CELP encoder according to the invention.

FIG. 6 discloses, by way of example only, a block diagram of a CELP encoder utilizing the proposed technique of time advancing the excitation signal. LPC analysis is performed once per frame, and LTP analysis and excitation search for every sub-frame in a frame comprising four sub-frames. The codes also includes a look-ahead buffer for input speech.

Encoding process of the invention comprises similar general steps as the prior art methods. LPC analysis 604 provides LP parameters, and LPT analysis 602 results lag T and gain g2 terms. Optimal excitation search loop comprises codebook 606, multiplier 616, LTP/adaptive codebook and LPC synthesis filters 608, 610, adder 618, weighting filter 612 and search logic 614. In addition, memory 622 for storing the selected excitation vector or indication thereof for a certain sub-frame and combine logic 620 to join the last half of previously selected and stored excitation vector, which was calculated during analysis of previous sub-frame but targeted for the first half of the current sub-frame, and the first part of the currently selected excitation vector for gain determination as described later are included.

The first difference between prior art solutions and the one of the invention occurs in connection with the calculation of the target signal for the excitation codebook search. If the excitation codebook is shifted for example half of a sub-frame ahead, the latter half of the codebook resides in the next sub-frame. Considering the last sub-frame in a frame, the look-ahead buffer may be correspondingly exploited. In addition, the amount of shifting can be varied on the basis of a separate (e.g. manually controlled) shift control parameter or of the characteristics of the input data, for example. The parameter may be received from an external entity, e.g. from a network entity such as a radio network controller in the case of a mobile terminal. Input data may be statistically analysed and, if seen necessary (e.g. occasional peak formations found in the target signal), the shifting can be dynamically introduced to the coding process or the existing shifting may be altered. Then the selected shift parameter value can be transmitted to the receiving end (to be used by the decoder) either separately or as embedded in the speech frames or signalling. The transmission may occur e.g. once per frame or upon change in the parameter value.

Figure 8A:
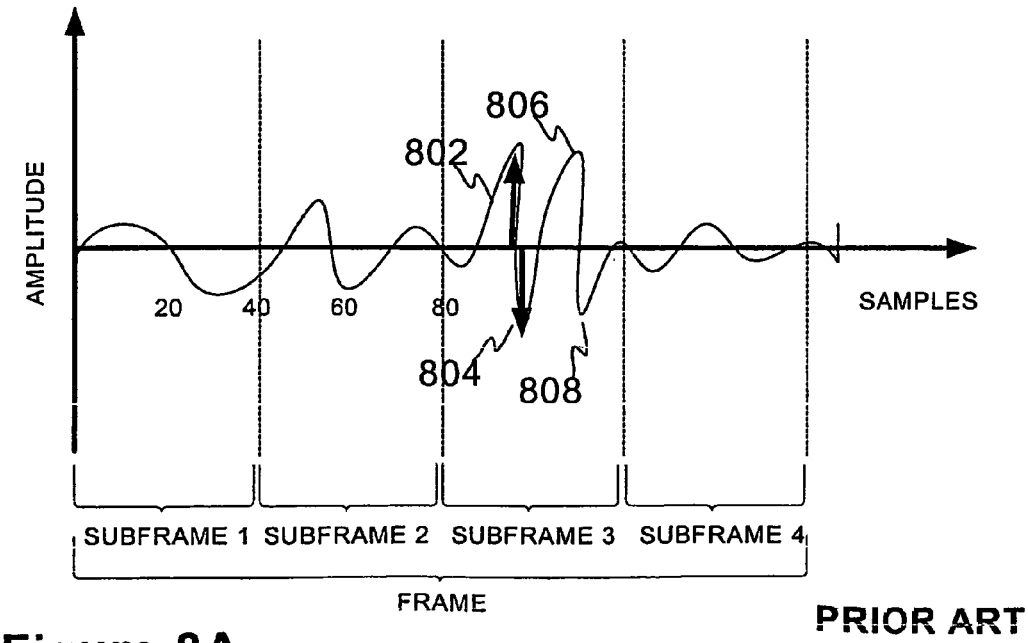
FIG. 8A illustrates target signal modeling with fixed two pulses per sub-frame in a conventional speech codec.
Figure 8B:
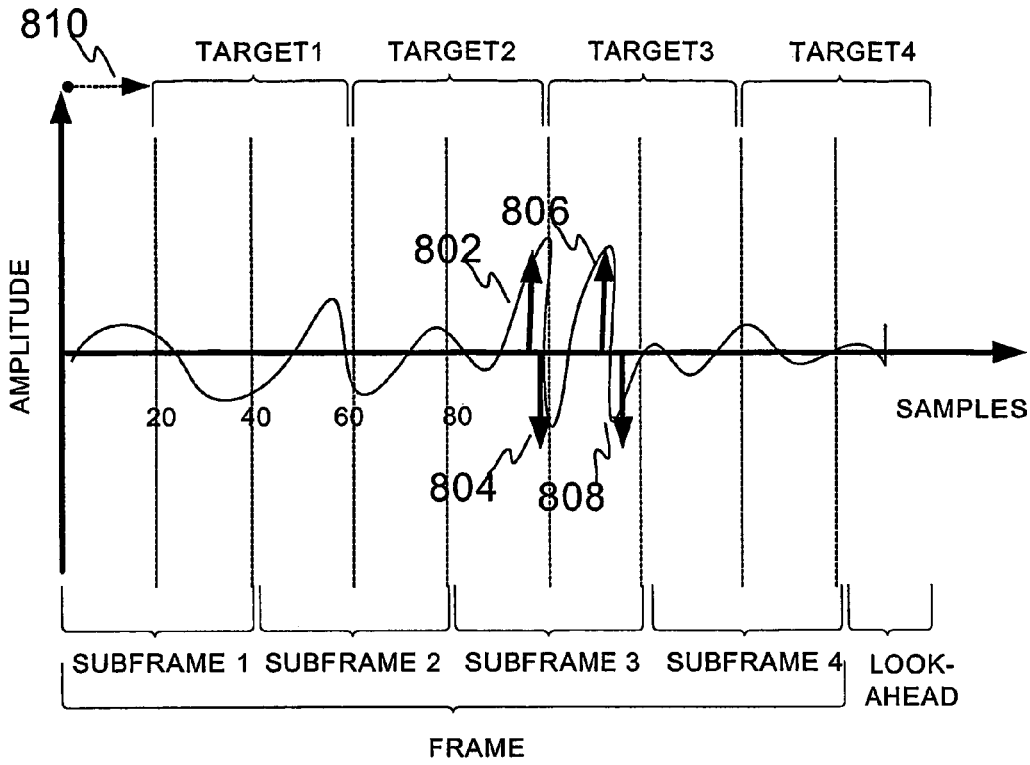
FIG. 8B illustrates target signal modeling with a maximum of four pulses per sub-frame in accordance with the invention.

In FIG. 8B, a portion of a target signal (effectively a speech signal from which the effect of adaptive codebook is removed as described hereinbefore) divided into a frame of four sub-frames and a look-ahead buffer are disclosed. The optimal excitation code vector is determined by minimizing the error $$e^2=(\tilde{s}_{adv}-g_{adv}Hc)^2 \tag{5}$$

where $\tilde{s}_{adv}$ is the new advanced target signal comprising latter half of the current sub-frame's target and first half of the following sub-frame's target. The division is visible in FIG. 8B; target (sub-)frame windows are shifted 810 half a sub-frame ahead in time in relation to the corresponding sub-frames. In this example, the look-ahead buffer equals to half a size of a sub-frame thus limiting (or in other words, enabling) the possible time shift between target and actual sub-frames to the same amount, i.e. time shift occurs between 0 and L/2, where L is the length of a sub-frame. As a generalization, shift shall be defined as equal or less to the length of the look-ahead buffer if a proper target signal should always be calculable from the input signal truly existing in the buffer. Note that memory 622 is not utilized in calculating the excitation vector.

Optionally, if also impulse response matrix H has been calculated on sub-frame basis, a time shift equivalent to one of the target signal may be introduced to it for minimizing the error defined by equation 5. Correspondingly, if none of the speech parameters is actually modeled on a sub-frame basis and only frames are analysed as such, it makes no substantial difference to the applicability of the invention.

Referring to equation 2, the pulse positions for an advanced excitation vector are calculated respectively also in this case but with time advanced target and optionally with similarly advanced impulse response matrix. Possible advancing of gain factor $g_{adv}$ is more or less mere academic issue, as the gain factor is not needed in this solution model for determining the optimal excitation.

Meanwhile, codebook gain g for the excitation vector is calculated on the basis of the actual sub-frame as follows $$g=\frac{\tilde{s}^T Hc_c}{c_c^T H^T Hc_c} \tag{6}$$

where $c_c$ is a joint excitation vector $$c_c=[c_1^T c_2^T]^T \tag{7}$$

consisting of subvectors $c_i=c_{i-1}(k)$, k=L/2+1 . . . L and $c_2=c_i(l)$, l=1 . . . L where $c_i$ corresponds to the excitation vector calculated in the i:th sub-frame and L is the length of the sub-frame and the excitation vector. Contents of memory 622 are this time needed in the procedure in order to provide latter half of previous sub-frame to the joint vector.

As the excitation vectors are just shifted during analysis and synthesis stages in encoder/decoder, their internal structure remains intact; the coding of pulse locations can be kept original and the structure of parameterised frames transferred over the transmission channel is not changed. Thus also data handling like different parameter insertion/extraction routines needed in the encoder/decoder do not require modifications in a traditional coder to be converted into conformity with the proposed solution.

Figure 9A:
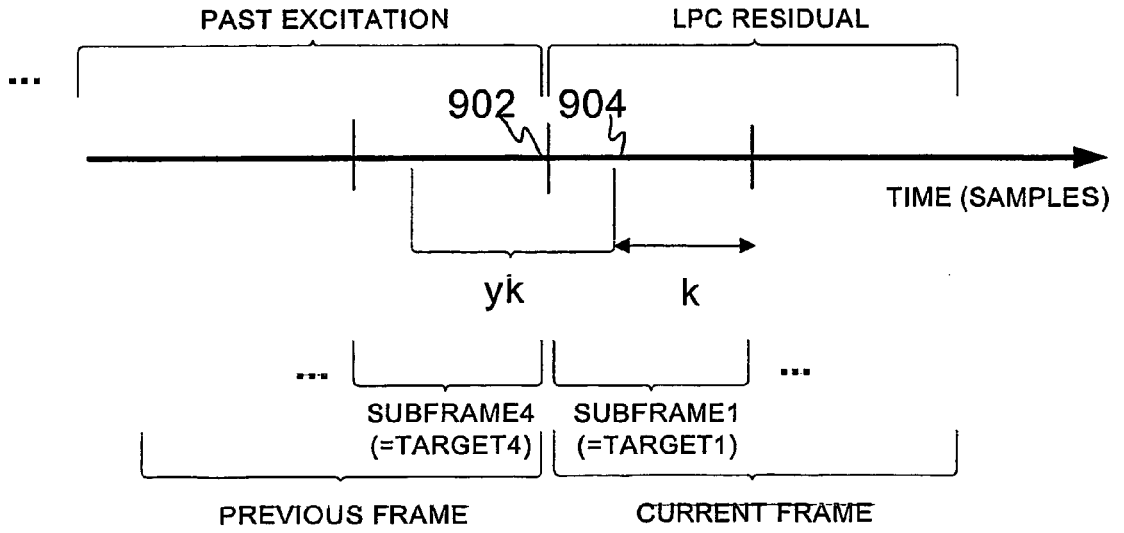
PRIOR ART Figure 9A
FIG. 9A illustrates a scenario wherein LP residual has to be used as a substitute for true excitation signal in a closed-loop LTP parameter search of conventional codecs.
Figure 9B:
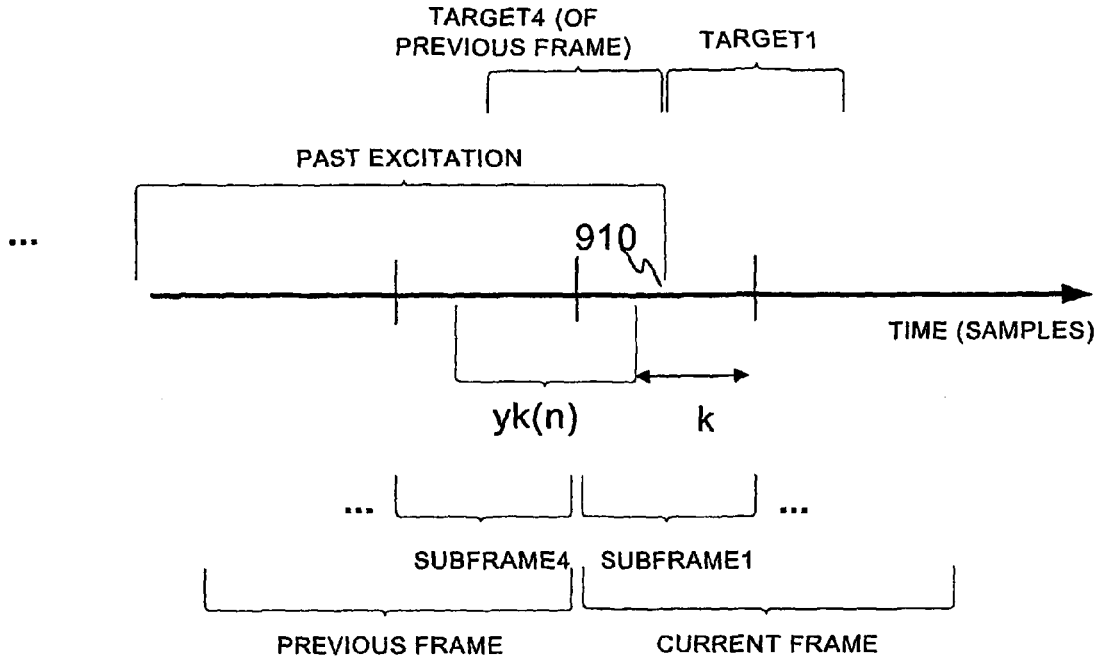
FIG. 9B illustrates a scenario wherein time advanced excitation is readily available for further use in a closed-loop LTP parameter search of the current invention.

And what comes to the LTP analysis and an adaptive codebook closed-loop search thereof in the advanced excitation CELP codec, the situation is depicted in FIG. 9B. Differing from the prior art solutions, past excitation available extends to a point 910 at the border of the time advanced target signal for the last-sub-frame of the previous frame and the first time advanced target signal of the current frame. Hence, the LTP analysis is improved as the true excitation can be at least partly utilized instead of mere LP residual during the closed-loop search. The same analogy applies to the following sub-frames or a scenario wherein sub-frames are not used at all and modeling takes place in frame units only.

Figure 7:
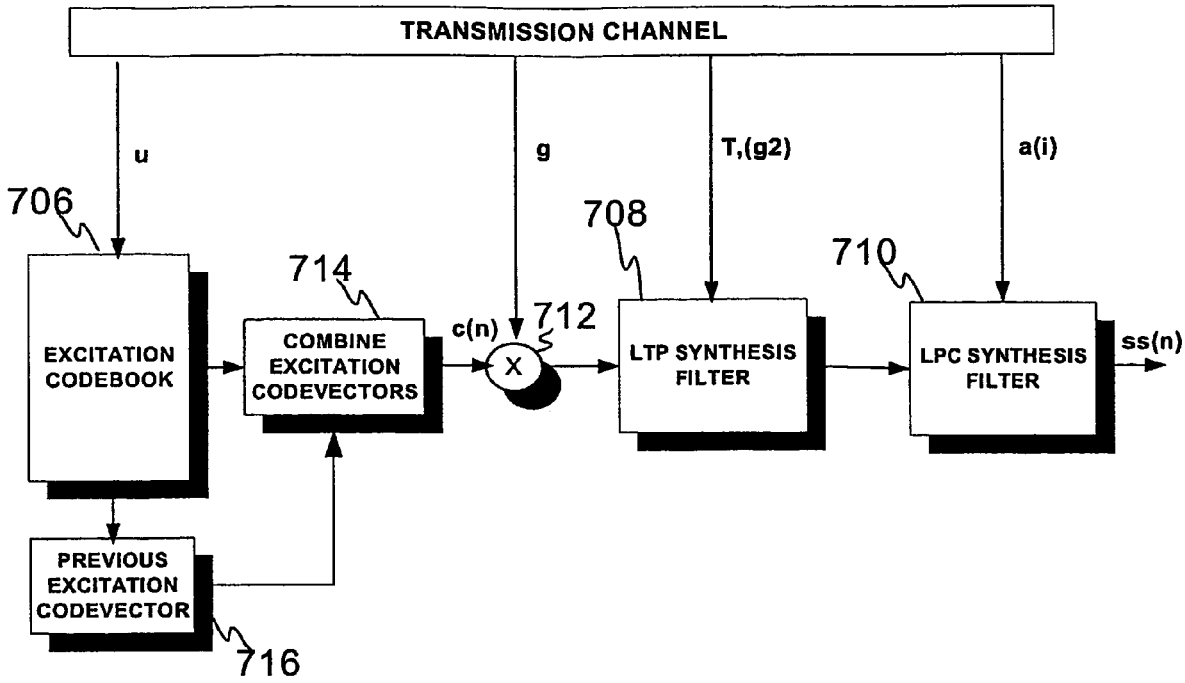
FIG. 7 illustrates a block diagram of a CELP decoder according to the invention.

A block diagram of the decoder of the invention is disclosed in FIG. 7. The decoder receives the excitation codebook index u, excitation gain g, LTP coefficients T, g2 (if present), and LP parameters a(i). First the decoder resolves the excitation vector from codebook 706 by utilizing index u and combines the retrieved vector with the previous sub-frame vector (memory) 716 as explainer earlier. The latter half of previous vector is attached to the first half of the current vector in block 714 after which the original current vector or at least the latter half thereof (or indication thereof) is stored in memory 716 for future use. The created joint vector is then multiplied 712 by gain g, and filtered through LTP synthesis 708 and LPC synthesis 710 filters in order to produce a synthesized speech signal ss(n) in the output.

Figure 10:
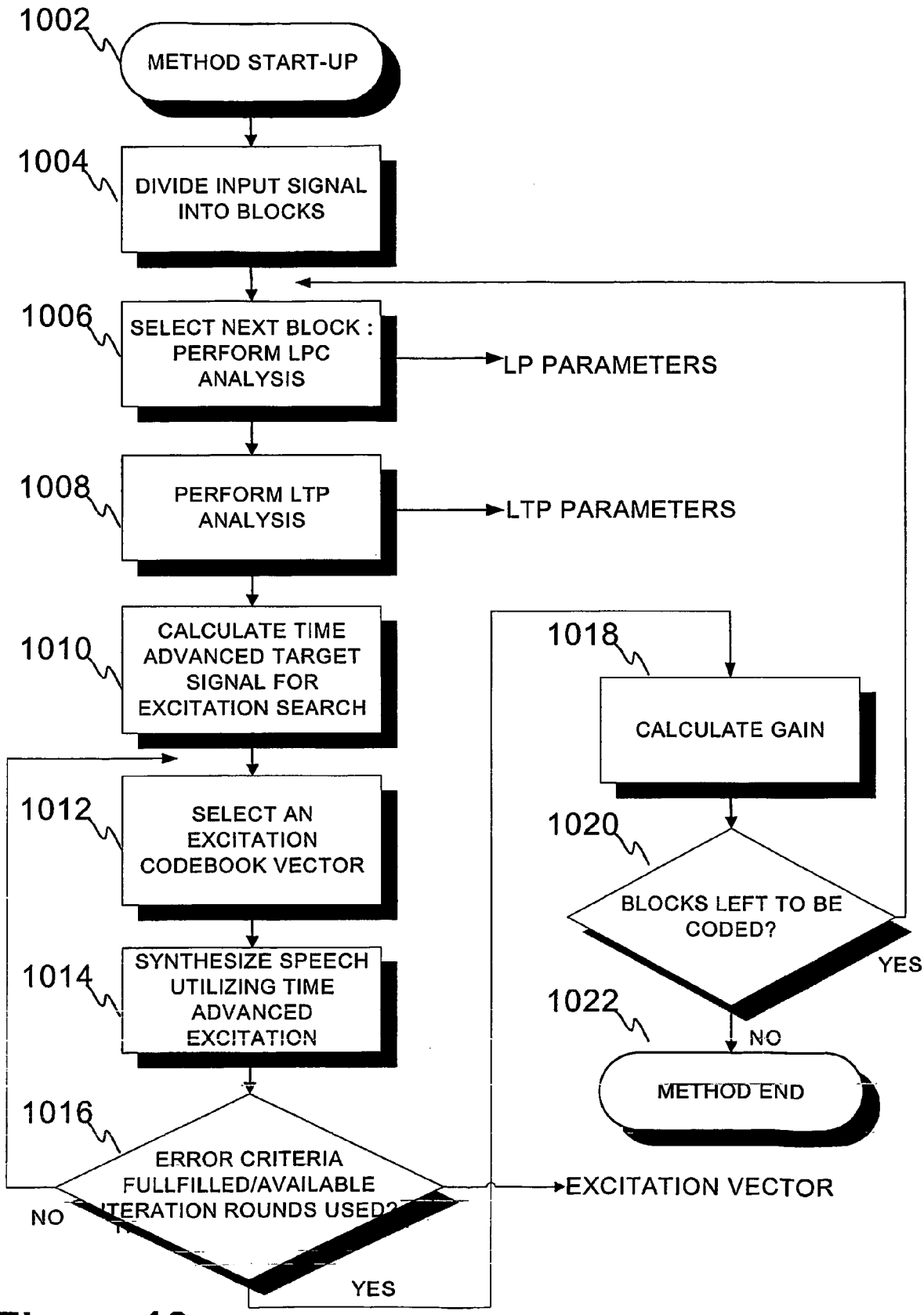
FIG. 10 discloses a flow diagram of the method of the invention for encoding a data signal.
Figure 11:
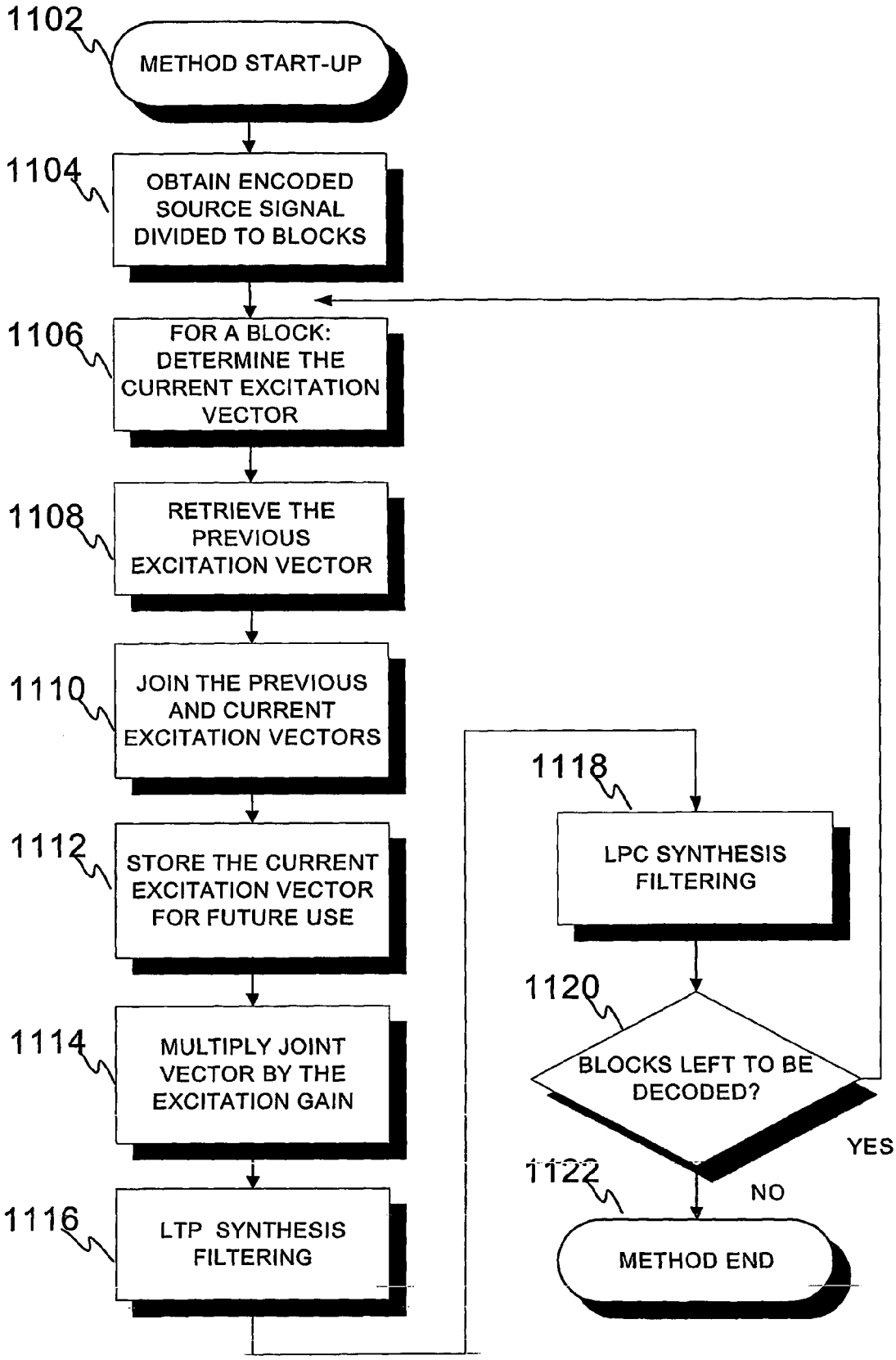
FIG. 11 discloses a flow diagram of the method of the invention for decoding an encoded data signal.

A flow diagram of the encoding method is disclosed in FIG. 10. Respectively, the decoding flow diagram is depicted in FIG. 11. The flow diagrams are constructed to future facilitate the understanding of encoder internals although the same basic principles can already be found in the block diagrams of FIGS. 6 and 7. Step 1002 corresponds to method start-up where e.g. filter memories and parameters are initialised. In step 1004 the source signal is, if not already, divided into blocks to be parameterized. Blocks may, for example, be equivalent to frames or sub-frames of the aforepresented embodiment. Although the flow diagrams in FIGS. 10 and 11 handle the source data on a single level of block hierarchy, the solutions corresponding to the actual embodiment where source data was first divided into top-level blocks like frames and then to the sub-blocks (such as sub-frames) thereof are possible. Part of the overall analysis may be thus executed on higher level and rest on lower level, like frame level LPC analysis and sub-frame level excitation vector analysis in the disclosed embodiment. Therefore, it's not crucial to the invention what type of hierarchy is used, or on what levels certain parameters are analysed as long as the excitation signal analysis exploits time advancing in relation to the actual block division of that level. In step 1006 a new block is selected for encoding and LPC analysis is performed resulting a set of LP parameters. Such parameters can be transferred to the recipient as such or in a coded form (as line spectral pairs, for example), a table index or utilizing whatever suitable indication. The following step includes LTP analysis 1008 outputting open-loop LTP parameters for the closed-loop LTP/adaptive codebook parameter search. As described hereinbefore, a time advanced target signal for excitation search is defined in step 1010. In analysis-by-synthesis type excitation search loop an excitation vector is selected 1012 from the excitation codebook and used in synthesizing the speech 1014. Procedure is repeated until the maximum count for a number of iteration rounds is reached or the predefined error-criteria is met 1016. The excitation vector producing the smallest error is normally the one to be selected. The selected vector (or other indication thereof such as a codebook index) or at least the part thereof corresponding to the next block, is also stored for further use. The excitation gain is calculated in step 1018. The overall encoding process is continued from step 1006 if any unprocessed blocks left 1020, otherwise the method is ended in phase 1022.

In step 1102 the decoding process is ramped up with necessary initialisations etc. Encoded data is received 1104 in blocks that are, for example, buffered for later decoding. The current excitation vector for the block under reconstruction is determined by utilizing the received data in step 1106, which may mean, for example, retrieving a certain code vector from a codebook on the basis of received codebook index. in step 1108 the previous excitation vector (or in practise the required part, e.g. last half, thereof) or indication thereof is retrieved from the memory and attached to the relevant first part of the current vector in phase 1110. Then the current vector (or the more relevant latter part of it) is stored 1112 in the memory (as an index, true vector or other possible derivative/indication) to be used in connection with the decoding of the next block. The joint vector is multiplied by excitation gain in phase 1114 and finally filtered through LTP synthesis 1116 and LPC synthesis 1118 filters. LTP and LP parameters may have been received as such or as coded (indications like table index, or in a line spectral pair form etc). If there are no blocks left to be decoded 1120, the method execution is redirected to step 1106. Otherwise the method is ended 1122. In many cases, step ordering presented in the diagrams may not be an essential issue; for example, the execution order of phases 1106 and 1108, and 1110 and 112 can be reversed if needed purposeful.

Figure 12:
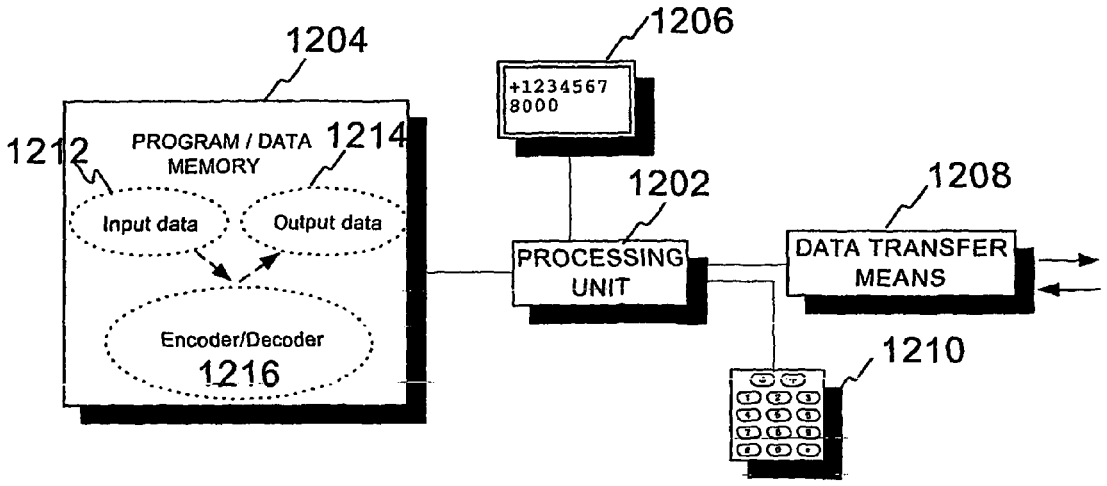
FIG. 12 discloses a block diagram of a device according to the invention.

FIG. 12 depicts one option for basic components of a device like a communications device (e.g. a mobile terminal), a data storage device, an audio recorder/playback device, a network element (e.g. a base station, a gateway, an exchange or a module thereof), or a computer capable of processing, storing, and accessing data in accordance with the invention. Memory 1204, divided between one or more physical chips, comprises necessary code 1216, e.g. in a form of a computer program/application, and data 1212; a necessary input for the proposed method producing an encoded (or respectively decoded) version 1214 as an output. A processing unit 1202, e.g. microprocessor, a DSP (digital signal processor), a microcontroller, or a programmable logic, is required for the actual execution of the method including the encoding and/or decoding of data 1212 in accordance with instructions 1216 stored in memory 1204. Display 1206 and keypad 1210 are in principle optional components but still often needed for providing necessary device control and data visualization means (~user interface) to the user. Data transfer means 1208, e.g. a CD/floppy/hard drive or a network adapter, are required for handling data exchange, for example acquiring source data and outputting processed data, with other devices; Data transfer means 1208 may also indicate audio parts like transducers (A/D and D/A converters, microphone, loudspeaker, amplifiers etc) that are used to input the audio signal for processing and/or output the decoded signal. This scenario is applicable, for example, in the case of mobile terminals and various audio storage and/or playback devices such as audio recorders and dictating machines utilizing the method of the invention. The code 1216 for the execution of the proposed method can be stored and delivered on a carrier medium like a floppy, a CD or a memory card. Furthermore, a device performing the data encoding and/or decoding according to the invention may be implemented as a module (e.g. a codec chip or circuit arrangement) included in or just connected to some other device. Then the module does not have to contain all the necessary code means for completing the overall task of encoding or decoding. The module may, for example, receive at least some of the filter parameters like LP or LPT parameters from an external entity in addition to the unencoded or encoded data and determine/construct just the excitation signal by itself.

The scope of the invention can be found in the following claims. However, utilized devices, method steps, data structures etc may vary significantly depending on the current scenario, still converging to the basic ideas of this invention. For example, it is clear that the size reduction aspect of source data is not a necessary, definitely a typical though, condition for utilizing the proposed method; it can be used just for representing and analysing the source data with a number of parameters. In addition to data transfer solutions the invention may be applied in a single device only for data storage purposes. Furthermore, any kind of source data can be used in the method, not just speech. However, with data carrying speech characteristics, i.e. data for which the source-filter approach fits well, the modeling results are presumably most accurate. Still further, the invention may be used in any kind of device capable of executing the necessary processing steps; the applicable device and component types are thus not strictly limited to the ones listed hereinbefore.

REFERENCES

[1] Kondoz A. M., Digital Speech; Coding for Low Bit Rate Communications Systems, Wiley 1994/2000

[2] Rabiner L. R., Schafer R. W., Digital processing of Speech Signals, Prentice-Hall 1978

[3] 3GPP TS 26.090 AMR speech Codec; Transcoding Functions v.5.0.0 Release 5, 3GPP TS 2002

The invention claimed is:

1. A coding method comprising:

extracting a first set of parameters related to a filter describing properties of a first block covering a first time period, extracting a second set of parameters related to a excitation signal for said filter, where said second set of parameters is determined from and describing properties of both the first block and a second block following the first block within a second time period starting later than said first time period and extending outside said first time period; and extracting at least one parameter related to said excitation signal on the basis of said second set of parameters relating to said first and second blocks, and of previously extracted and at least partially stored second set of parameters relating to a block preceding said first block and said first block.

2. The method of claim 1, further comprising storing at least the part of said second set of parameters or an indication thereof which corresponds to said second block in order, to use said stored parameters for extracting at least one parameter of said second block following said first block.

3. The method of claim 1, wherein said at least one parameter is substantially a gain parameter.

4. The method of claim 1, wherein said first set of parameters substantially indicates a number of LPC (Linear Predictive Coding) parameters.

5. The method of claim 1, wherein said second set of parameters substantially indicates a certain excitation vector in an excitation codebook comprising a plurality of vectors.

6. The method of claim 1, wherein the starting point of said second time period is varied within said first time period.

7. The method of claim 1, wherein at least said second set of parameters is extracted by utilizing substantially an analysis-by-synthesis loop.

8. The method of claim 1, wherein said synthesis filter includes at least one of the following: LPC (Linear Prediction Coding) synthesis filter and LTP (Long-Term Prediction) synthesis filter.

9. The method of claim 1, wherein said source data is substantially speech.

10. The method of claim 1, wherein said first set of parameters is utilized in extracting said second set of parameters.

11. A method for decoding encoded data signal divided into consecutive blocks having the steps of obtaining a first set of parameters for constructing a synthesis filter, said first set of parameters describing properties of a first block covering a first time period, obtaining a second set of parameters for constructing an excitation signal for said synthesis filter, said second set of parameters describing properties of both the first block and a second block following the first block within a second time period starting later than said first time period and extending outside said first time period, obtaining at least part of a previous second set of parameters for constructing an excitation signal for said synthesis filter, said previous second set of parameters describing properties of said first block during at least the time period between the beginning of said first time period and the beginning of said second time period, combining the contribution of said previous second set of parameters and said second set of parameters for said excitation signal within said first time period, constructing an excitation signal of said first block for said synthesis filter by utilizing said combination, and filtering said constructed excitation signal through said synthesis filter.

12. The method of claim 11, wherein said first set of parameters substantially indicates a number of LPC (Linear Predictive Coding) parameters.

13. The method of claim 11, wherein said second set of parameters substantially indicates a certain excitation codebook vector in an excitation codebook comprising a plurality of vectors.

14. The method of claim 11, further having the step of storing at least the part of said second set of parameters or an indication thereof which corresponds to said second block in order to use said stored parameters for creating the excitation signal of said second block.

15. An encoding device comprising:

a first analysis module configured to extract a first set of parameters corresponding to a first block of a source signal, wherein the first block covers a first time period; and a second analysis module configured to extract a second set of parameters related to an excitation signal, wherein the second set of parameters corresponds to the first block and a second block of the source signal, and wherein the second block covers a second time period commencing after a start of the first time period and ending after an end of the first time period, wherein at least one parameter related to said excitation signal on the basis of said second set of parameters is extracted; and a third analysis module configured to extract at least one parameter relating to said excitation signal on the basis of said second set of parameters related to said first and second blocks, and of previously extracted and at least partially stored second set of parameters relating to a block preceding said first block and said first block.

16. The encoding device of claim 15, wherein said first set of parameters is received from an external entity.

17. The encoding device of claim 15, wherein said first set of parameters is extracted by utilizing said source data.

18. The encoding device of claim 15, further comprising a memory configured to store at least the part of said second set of parameters or an indication thereof corresponding to said second block in order to use said stored parameters for extracting at least one parameter of said second block following said first block.

19. The encoding device of claim 15, further comprising a processing unit configured to vary the starting point of said second time period within said first time period.

20. The encoding device of claim 15, wherein said second set of parameters is extracted by utilizing substantially an analysis-by-synthesis loop.

21. The encoding device of claim or 15, wherein said first set of parameters is utilized in extracting said second set of parameters.

22. An electronic device for decoding source data divided into consecutive blocks, said device comprising processing means and memory means for processing and storing instructions and data, and data transfer means for accessing data, said device arranged to obtain a first set of parameters for constructing a synthesis filter, said first set of parameters describing properties of a first block covering a first time period, a second set of parameters for constructing an excitation signal for said synthesis filter, said second set of parameters describing properties of both the first block and a second block following the first block within a second time period starting later than said first time period and extending outside said first time period, at least part of a previous second set of parameters for constructing an excitation signal for said synthesis filter, said previous second set of parameters describing properties of said first block during at least the time period between the beginning of said first time period and the beginning of said second time period, said device further arranged to combine the contribution of said previous second set of parameters and said second set of parameters for said excitation signal within said first time period, to construct an excitation signal of said first block for said synthesis filter by utilizing said combination, and to filter said constructed excitation signal through said synthesis filter.

23. The device of claim 22 that is substantially a mobile terminal, a network element, a data storage device, an audio playback device or a dictating machine.

24. The device of claim 22 that is substantially a decoder module or an encoder-decoder module.

25. An article of manufacture including a computer readable medium having instructions stored thereon that, if executed by a computing device, cause the computing device to perform operations comprising:

extracting a first set of parameters at a first analysis module, wherein the first set of parameters corresponds to a first block of a source signal covering a first time period; and extracting a second set of parameters related to an excitation signal at a second analysis module, wherein the second set of parameters corresponds to the first block and a second block of the source signal, and wherein the second block covers a second time period commencing after a start of the first time period and ending after an end of the first time period, wherein at least one parameter related to said excitation signal on the basis of said second set of parameters is extracted.

26. An article of manufacture including a computer readable medium having instructions stored thereon that, if executed by a computing device, cause the computing device to perform operations comprising:

constructing a synthesis filter using a first set of parameters describing properties of a first block covering a first time period, constructing an excitation signal for said synthesis filter using a second set of parameters describing properties of both the first block and a second block following the first block within a second time period starting later than said first time period and extending outside said first time period, constructing an excitation signal for said synthesis filter using at least part of a previous second set of parameters describing properties of said first block during at least the time period between the beginning of said first time period and the beginning of said second time period, combining the contribution of said previous second set of parameters and said second set of parameters for said excitation signal within said first time period, constructing an excitation signal of said first block for said synthesis filter by utilizing said combination, and filtering said constructed excitation signal through said synthesis filter.

* * * * *

UNITED STATES PATENT AND TRADEMARK OFFICE

CERTIFICATE OF CORRECTION

PATENT NO. : 7,869,993 B2
APPLICATION NO. : 10/574990
DATED : January 11, 2011
INVENTOR(S) : Ojala It is certified that error appears in the above-identified patent and that said Letters Patent is hereby corrected as shown below:

Column 13, line 63, in Claim 2, delete "order," and insert -- order --.

Column 14, line 21, in Claim 11, delete "steps of" and insert -- steps of: --.

Column 15, line 26, in Claim 21, delete "claim or 15," and insert -- claim 15, --.

Column 15, line 33, in Claim 22, delete "obtain" and insert -- obtain: --.

Signed and Sealed this
Twenty-fourth Day of May, 2011

David J. Kappos
*Director of the United States Patent and Trademark Office*